US007569992B2

(12) United States Patent
Choi et al.

(10) Patent No.: US 7,569,992 B2
(45) Date of Patent: Aug. 4, 2009

(54) PLASMA DISPLAY PANEL AND MANUFACTURING METHOD THEREOF

(75) Inventors: Jeong Sik Choi, Daegu (KR); Eung Chul Park, Gumi-si (KR)

(73) Assignee: LG Electronics Inc., Seoul (KR)

( * ) Notice: Subject to any disclaimer, the term of this patent is extended or adjusted under 35 U.S.C. 154(b) by 577 days.

(21) Appl. No.: 11/324,341

(22) Filed: Jan. 4, 2006

(65) Prior Publication Data

US 2006/0145614 A1 Jul. 6, 2006

(30) Foreign Application Priority Data

Jan. 5, 2005 (KR) ..... 10-2005-0000985
Jan. 5, 2005 (KR) ..... 10-2005-0000986
Jan. 21, 2005 (KR) ..... 10-2005-0005982

(51) Int. Cl.
*H01J 17/49* (2006.01)

(52) U.S. Cl. ..... 313/587; 313/582

(58) Field of Classification Search ..... 313/582–587; 315/169.4; 345/37, 41, 60
See application file for complete search history.

(56) References Cited

U.S. PATENT DOCUMENTS

2004/0145316 A1* 7/2004 Nishitani et al. ..... 313/587
2006/0055324 A1* 3/2006 Hasegawa et al. ..... 313/587

FOREIGN PATENT DOCUMENTS

| | | | |
|---|---|---|---|
| CN | 1497642 | A | 5/2004 |
| EP | 1 408 529 | A2 | 4/2004 |
| JP | 06-310037 | | 11/1994 |
| KR | 10-2000-0048076 | A | 7/2000 |
| KR | 10-2002-0006479 | A | 1/2002 |
| KR | 10-2004-0037270 | A | 5/2004 |

OTHER PUBLICATIONS

European Search Report dated May 29, 2008.
Chinese Office Action dated Sep. 19, 2008.

* cited by examiner

*Primary Examiner*—Nimeshkumar D. Patel
*Assistant Examiner*—Christopher M Raabe
(74) *Attorney, Agent, or Firm*—Ked & Associates LLP

(57) ABSTRACT

Disclosed are a plasma display panel and a method of manufacturing the same. The plasma display panel according to the present invention comprises a front panel comprising a protective layer and a rear panel disposed apart from the front panel by a predetermined distance. The protective layer comprising magnesium oxide (MgO) is doped with scandium (Sc) and calcium (Ca). The plasma display panel according to the present invention has the advantage of excellent temperature-dependent panel characteristic. The plasma display panel according to the present invention also has the further advantage of excellent voltage margin of the address voltage.

31 Claims, 12 Drawing Sheets

PLASMA DISPLAY PANEL AND MANUFACTURING METHOD THEREOF

This Nonprovisional application claims priority under 35 U.S.C. § 119(a) on Patent Application No. 10-2005-0000985 filed in Korea on Jan. 5, 2005, Patent Application No. 10-2005-0000986 filed in Korea on Jan. 5, 2005, and Patent Application No. 10-2005-0005982 filed in Korea on Jan. 21, 2005, the entire contents of which are hereby incorporated by reference.

BACKGROUND OF THE INVENTION

1. Field of the Invention

The present invention relates to a Plasma Display Panel (PDP), and more particularly to a plasma display panel and a method of manufacturing the same, in which the temperature-dependent panel characteristic is improved.

2. Description of the Background Art

Generally, a plasma display panel has a plurality of unit cells, each being defined by a barrier rib disposed between a front panel and a rear panel. The unit cell is filled with a main discharge gas, such as neon (Ne), helium (He) and a gas mixture (Ne+He) of neon (Ne) and helium (He), and an inert gas containing a small amount of xenon (Xe).

When the gas is discharged by a high frequency voltage, the inert gas generates vacuum ultra-violet rays that excite phosphors deposited between the barrier ribs so that the phosphors emit visible light rays, thereby to implement images. Since the above described plasma display panel can be realized in a thin and light structure, it has been in the limelight as the next generation display apparatus.

FIG. 1 illustrates a schematic view showing the structure of a plasma display panel in accordance with a related art.

Referring to FIG. 1, the plasma display panel comprises a front panel 100 and a rear panel 110 combined with each other, while they are disposed apart from each other by a distance. The front panel 100 comprises a front glass 101 serving as a displaying surface, and a plurality of sustain electrode pairs, each pair comprising a scan electrode 102 and a sustain electrode 103, arranged on the front glass 101. The rear panel 110 comprises a rear glass 111 providing a rear surface of the plasma display panel and address electrodes 113 arranged on the rear glass 111 to intersect the sustain electrode pairs.

As described above, the front panel 100 comprises the plurality of sustain electrode pairs, in which each sustain electrode pair comprises a scan electrode 102 and a sustain electrode 103 for discharging mutually and sustaining the discharge in a cell, and in which each of the scan electrodes 102 and sustain electrodes 103 comprises a transparent electrode a made of indium tin oxide (ITO) and a bus electrode b made of a metal material, the electrodes a and b being in a pair.

The scan electrodes 102 and the sustain electrodes 103 are coated with one or more upper dielectric layer 104 which limits a discharge current and insulates each pair of sustain electrodes a and b from other sustain electrode pairs. Further, a protective layer 105 is formed on the surface of the upper dielectric layer 104.

The rear panel 110 comprises stripe type (or well type) barrier ribs 112 arranged in parallel with each other for defining a plurality of discharge spaces, i.e. discharge cells, and a plurality of address electrodes 113 arranged in parallel with the barrier ribs 112 for generating vacuum ultraviolet rays by causing an address discharge.

The rear panel 110 further comprises R, G, B phosphors 114 disposed on an upper portion thereof for emitting visible light rays, which display an image, upon the address discharge. A lower dielectric layer 115 is provided between the address electrodes 113 and the phosphors 114 to protect the address electrodes 113.

In the related art plasma display panel described above, the front panel having a protective layer made of magnesium oxide is manufactured according to the following method.

FIG. 2 illustrates the sequential order of manufacturing steps of the front panel of a related art plasma display panel.

In step a, as shown in FIG. 2, sustain electrode pairs, each pair comprising a scan electrode and a sustain electrode, are formed on a front glass.

Each of the scan and sustain electrodes comprises a transparent electrode and a bus electrode. The scan and sustain electrodes are formed by preparing a transparent electrode film made of indium tin oxide (ITO) which is made from indium oxide and tin oxide, laminating a dry film on the transparent electrode film, transferring a photoresist pattern on the dry film using a photo mask with a predetermined pattern, and etching the transparent electrode film, thereby forming transparent electrodes for the scan electrodes and the sustain electrodes.

The bus electrodes are formed on the transparent electrodes by printing photosensitive silver (Ag) paste by a screen-printing method, and performing a photolithography process and an etching process, sequentially. After forming the bus electrodes, a baking process is performed to heat the transparent electrodes and the bus electrodes to 550° C. thereby completing formation of the scan and sustain electrodes.

In step b, a dielectric layer is formed on the entire surface of the front glass on which the scan electrodes and sustain electrodes are formed.

According to an exemplary method for forming the dielectric layer, it is formed by coating and drying dielectric glass paste and baking the dielectric glass paste at a temperature of 500 to 600° C.

Finally, in step c, a protective layer of magnesium oxide (MgO) is formed on the dielectric layer by a chemical vapor deposition (CVD) method, an ion plating method, or a vacuum vapor deposition method.

In the plasma display panel, the front panel manufactured by the above described method is installed such that the protective layer of the front panel faces the rear panel.

Accordingly, when a driving voltage is applied to the sustain electrode pairs of the front panel and the address electrodes of the rear panel to display an image, a discharge is caused on the protective layers. In this instance, the driving voltage applied to the electrodes is determined depending on a discharge gap between the front panel and the rear panel, a kind and a pressure of a discharge gas filled in the discharge space, and characteristics of the dielectric layer and the protective layer. When the driving voltage is applied, the surface of the protective layer becomes the state described below.

FIG. 3 illustrates the state of the surface of the protective layer when a driving voltage is applied to the electrodes.

As shown in FIG. 3, if a plasma discharge is caused upon applying a driving voltage to the plasma display panel, positive ions and electrons having the opposite polarities move toward the opposite sides of the discharge space. Accordingly, the surface of the protective layer is divided into portions having the opposite polarities of charges. The charges accumulated on the protective layer are called wall charges.

Since the protective layer is made of an insulation material having high resistance, the wall charges keep remain on the surface of the protective layer. Accordingly, the discharge is sustained at a voltage lower than the driving voltage due to the wall charges.

Further, the protective layer lowers the discharge voltage of the plasma display panel by supplying secondary electrons. That is, the protective layer serves to enhance the discharge power efficiency from the viewpoint of the electrical aspect, and serves to prevent decomposition of the upper dielectric layer made of PbO from the viewpoint of the mechanical aspect, in which the decomposition of the upper dielectric layer is caused due to ion bombardment when it is exposed to plasma.

Since the protective layer plays the above described roles, it must be made of a material capable of playing its given roles enough, and must be excellent in transmittance of visible light rays so that the visible light rays emitted from the phosphors can transmit the front panel of the plasma display panel.

MgO is the material that meets the requirement of the protective layer, so that it has been used as a material for the protective layer so far. However, magnesium oxide (MgO) also has the disadvantage of the jitter characteristic, the discharge delay phenomenon in which a discharge is not caused right after application of an electrical signal for a discharge but is caused after some time lapses from the application of the electrical signal. Such jitter characteristic is resulted from a low emission rate of secondary electron, which is the originated in the unique characteristic of magnesium oxide (MgO), when ions from the plasma bombard MgO.

That is, hydrogen oxide ($H_2O$) and carbon dioxide ($CO_2$) in air are adsorbed onto the surface of magnesium oxide (MgO), and they cause chemical and physical deformation on the surface of the protective layer made of MgO. Due to the deformed surface of the protective layer, an emission rate of secondary is lowered, resulting in degradation of the discharge characteristic.

Accordingly, when generating a plasma discharge in a related art plasma display panel, a next discharge signal is needed to be input, waiting enough time in which a discharge can be caused, after a previous electrical signal is input, due to the jitter characteristic. Accordingly, the related art plasma display panel requires one or more circuit for scanning.

There is a tendency that the jitter characteristic becomes worse if a temperature of surroundings or the plasma display panel is low. Accordingly, at low temperature, an address discharge is unstable, resulting in miss writing. That is, a discharge cell is not selected at low temperature, thereby causing black noise to a display image.

In order to solve and obviate the above described problems and disadvantages of the related plasma display panel, a new material for the protective layer has been being developed and studies on improving the characteristics of magnesium oxide have been being made. For example, the magnesium oxide (MgO) protective layer is doped with some doping materials or the protective layer has a multi-layered structure.

SUMMARY OF THE INVENTION

Accordingly, an object of the present invention is to solve at least the problems and disadvantages of the background art.

An object of the present invention is to provide a plasma display panel with a protective layer excellent in panel characteristic depending on a temperature. Particularly, the present invention provides a plasma display panel comprising a protective layer having a short response time at low temperature, a narrow variation range of response time, and excellent address voltage margin at high temperature.

According to one embodiment of the present invention, there is provided a plasma display panel comprising a front panel comprising a protective layer, and a rear panel disposed apart from the front panel by a predetermined distance and combined with the front panel, wherein the protective layer comprising magnesium oxide (MgO) is doped with scandium (Sc) and calcium (Ca).

The quantity of the scandium (Sc) for doping in the protective layer ranges from 50 to 2000 ppm.

The quantity of the scandium (Sc) for doping in the protective layer ranges from 100 to 1000 ppm.

The quantity of the scandium (Sc) for doping in the protective layer ranges from 300 to 700 ppm.

The quantity of the calcium (Ca) for doping in the protective layer ranges from 100 to 1000 ppm.

According to another embodiment of the present invention, there is provide a plasma display panel comprising a front panel comprising a protective layer, and a rear panel disposed apart from the front panel by a predetermined distance and combined with the front panel, wherein the protective layer comprising magnesium oxide (MgO) is doped with scandium (Sc), silicon (Si), and calcium (Ca).

The quantity of the scandium (Sc) for doping in the protective layer ranges from 50 to 2000 ppm.

The quantity of the scandium (Sc) for doping in the protective layer ranges from 100 to 1000 ppm.

The quantity of the scandium (Sc) for doping in the protective layer ranges from 300 to 700 ppm.

The quantity of the silicon (Si) for doping in the protective layer ranges from 10 to 1000 ppm.

The quantity of the silicon (Si) for doping in the protective layer ranges from 30 to 500 ppm.

The quantity of the calcium (Ca) for doping in the protective layer ranges from 100 to 1000 ppm.

According to further the other embodiment of the present invention, there is provided a plasma display panel comprising a front panel comprising a protective layer, and a rear panel disposed apart from the front panel by a predetermined distance and combined with the front panel, wherein the protective layer comprising magnesium oxide (MgO) is doped with scandium (Sc) and silicon (Si).

The quantity of the scandium (Sc) for doping in the protective layer ranges from 50 to 2000 ppm.

The quantity of the scandium (Sc) for doping in the protective layer ranges from 100 to 1000 ppm.

The quantity of the scandium (Sc) for doping in the protective layer ranges 300 to 700 ppm.

The quantity of the silicon (Si) for doping in the protective layer ranges from 10 to 1000 ppm.

The quantity of the silicon (Si) for doping in the protective layer ranges from 30 to 500 ppm.

BRIEF DESCRIPTION OF THE DRAWINGS

The invention will be described in detail with reference to the following drawings in which like numerals refer to like elements, wherein.

DETAILED DESCRIPTION OF PREFERRED EMBODIMENTS

Preferred embodiments of the present invention will be described in a more detailed manner with reference to the drawings.

Figure 1:
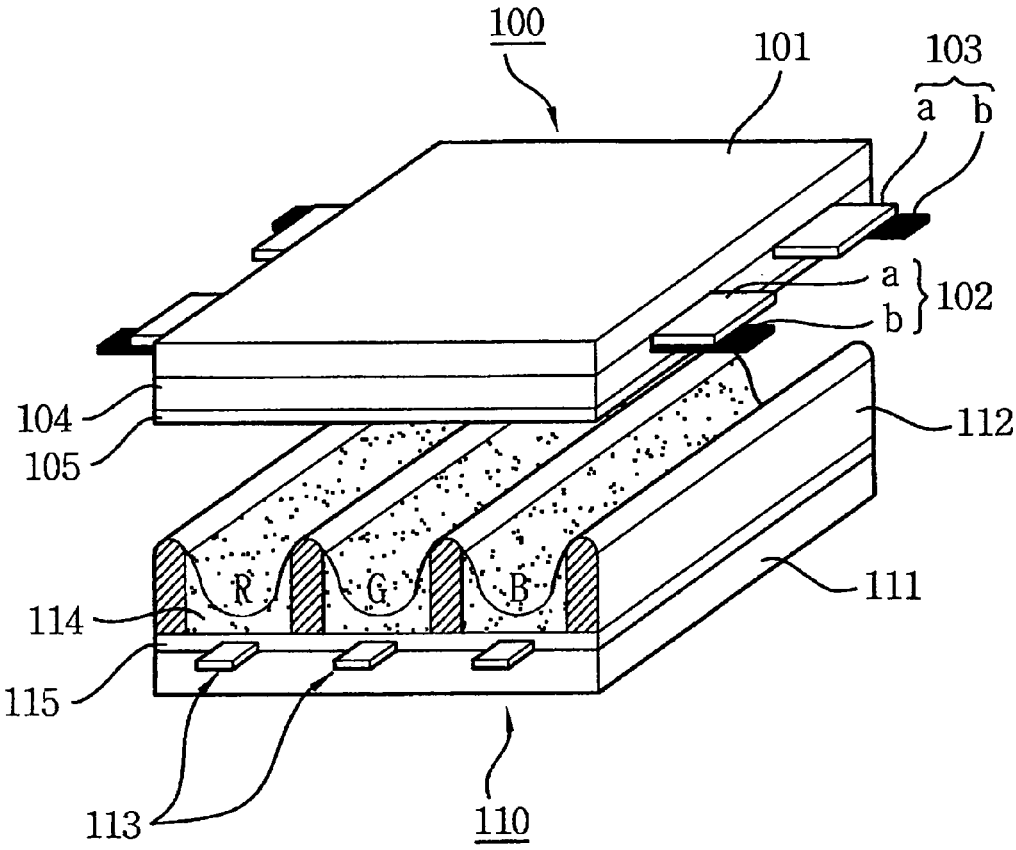
Fig. 1 Related Art
FIG. 1 is a schematic view illustrating the structure of a related art plasma display panel.
Figure 2:
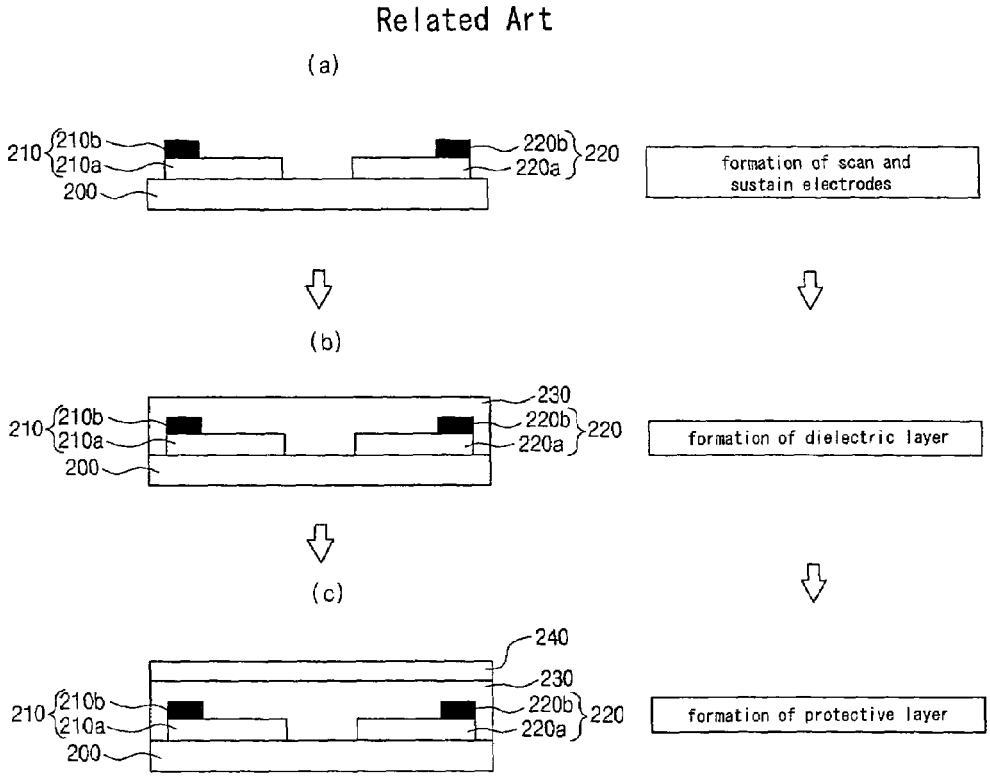
FIG. 2 is a view illustrating the sequential order of process steps in manufacturing a related art plasma display panel.
Figure 3:
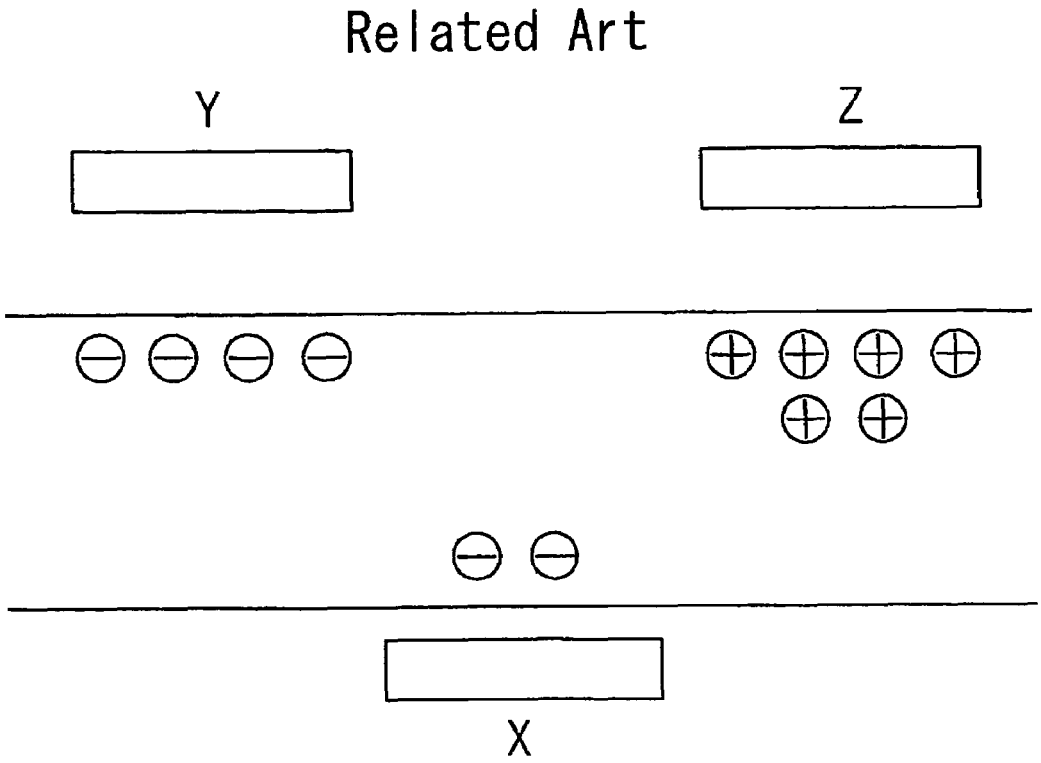
FIG. 3 is a schematic view illustrating a protective layer and the surface of the protective layer, in which a driving voltage is applied to the plasma display panel.
Figure 4:
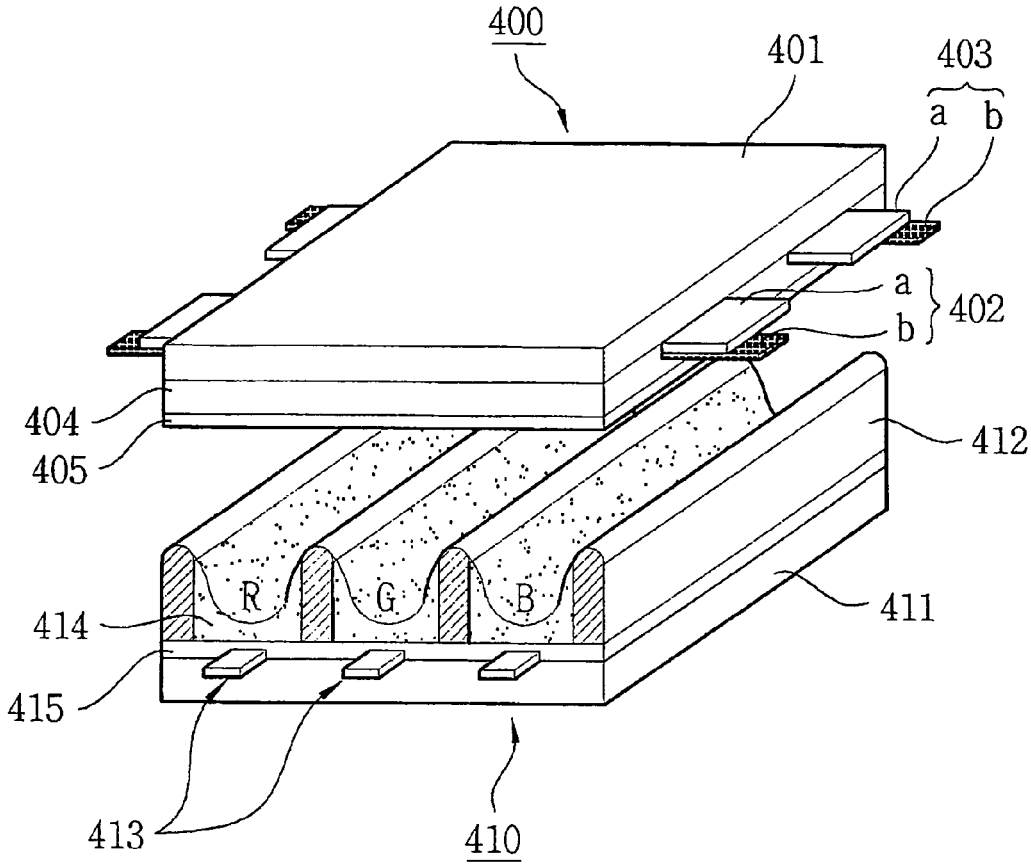
FIG. 4 is a schematic view illustrating the structure of a plasma display panel according to one embodiment of the present invention.

FIG. 4 schematically illustrates the structure of a plasma display panel according to an embodiment of the present invention.

Referring to FIG. 4, the plasma display panel comprises a front panel 400 being comprised of a front glass 401 on which an image is displayed and a plurality of sustain electrode pairs, each pair including a scan electrode 402 and a sustain electrode 403, and a rear panel 410 being comprised of a rear glass 411 providing the rear surface of the plasma display panel and a plurality of address electrodes 413 arranged on the rear glass 411 to intersect the sustain electrode pairs, wherein the front panel 400 and the rear panel 410 are combined with each other while they are disposed apart from each other.

In the front panel 400, the scan electrode 402 and the sustain electrode 403 make a pair to mutually generate a discharge in a discharge cell and maintain the discharge. Further, each of the scan electrodes 402 and the sustain electrodes 403 comprises a transparent electrode a made of a transparent material and a bus electrode b made of a metal material.

The scan electrodes 402 and the sustain electrodes 403 are covered with a dielectric layer 404 which limits a discharge current and insulates the electrode pairs from each other pair, and the dielectric layer 404 is covered with a protective layer 405.

The rear panel 410 comprises stripe-type barrier ribs 412 which define discharge spaces, i.e. discharge cells and are arranged in parallel with each other. The rear panel 410 further comprises a plurality of address electrodes 413 arranged in parallel with the barrier ribs 412.

R, G and B phosphors 414 are covered on the surface of the rear panel 410 to emit visible light rays for displaying an image upon address discharges. The rear panel 410 further comprises a lower dielectric layer 415 disposed between the address electrodes 413 and the phosphors 414 for protecting the address electrodes 413.

The protective layer 405 is doped with scandium (Sc) and calcium (Ca).

Figure 5:
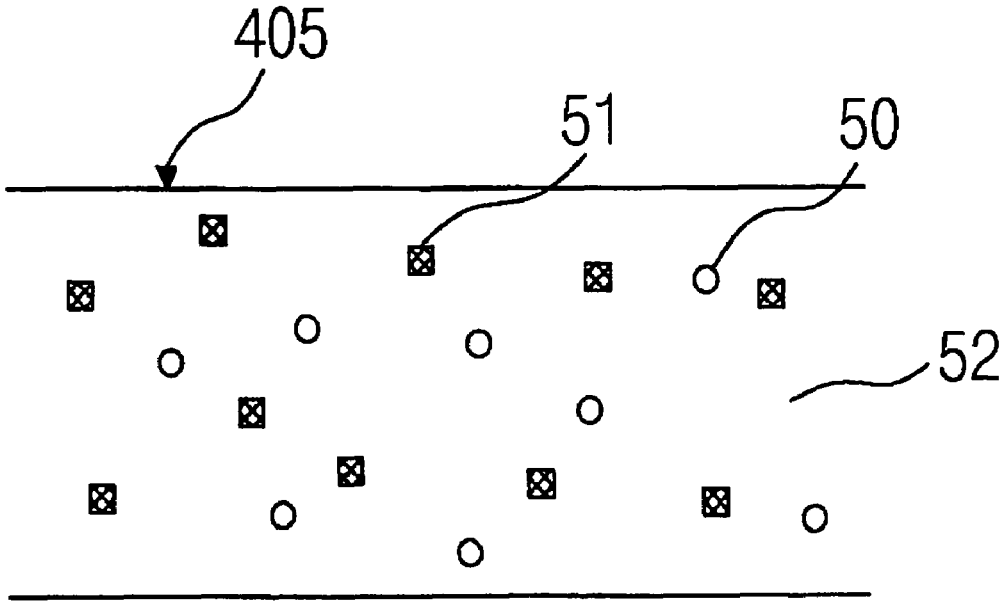
FIG. 5 is a schematic view illustrating a protective layer of the plasma display panel according to the embodiment of the present invention.

FIG. 5 is a view for explaining the surface of the protective layer 405 of the plasma display panel according to the embodiment of the present invention in detail.

Referring to FIG. 5, the protective layer 405 of the plasma display panel according to the embodiment of the present invention is made of mainly magnesium oxide (MgO) 52 and doped with doping materials, such as scandium (Sc) 50 and calcium (Ca) 51. In FIG. 5, an element of the scandium (Sc) 50 is expressed as a circle and an element of the calcium (Ca) 51 is expressed as a rectangular.

As such, the scandium (Sc) 50 and the calcium (Ca) 51 contained in the protective layer plays a role to improve the temperature dependent characteristic of the protective layer 405. The temperature dependent characteristic can be described in more detail below.

In the case in which the protective layer is doped with scandium (Sc) 50, a response time is improved. Such improvement of the response time will be described with reference to FIG. 6.

Figure 6:
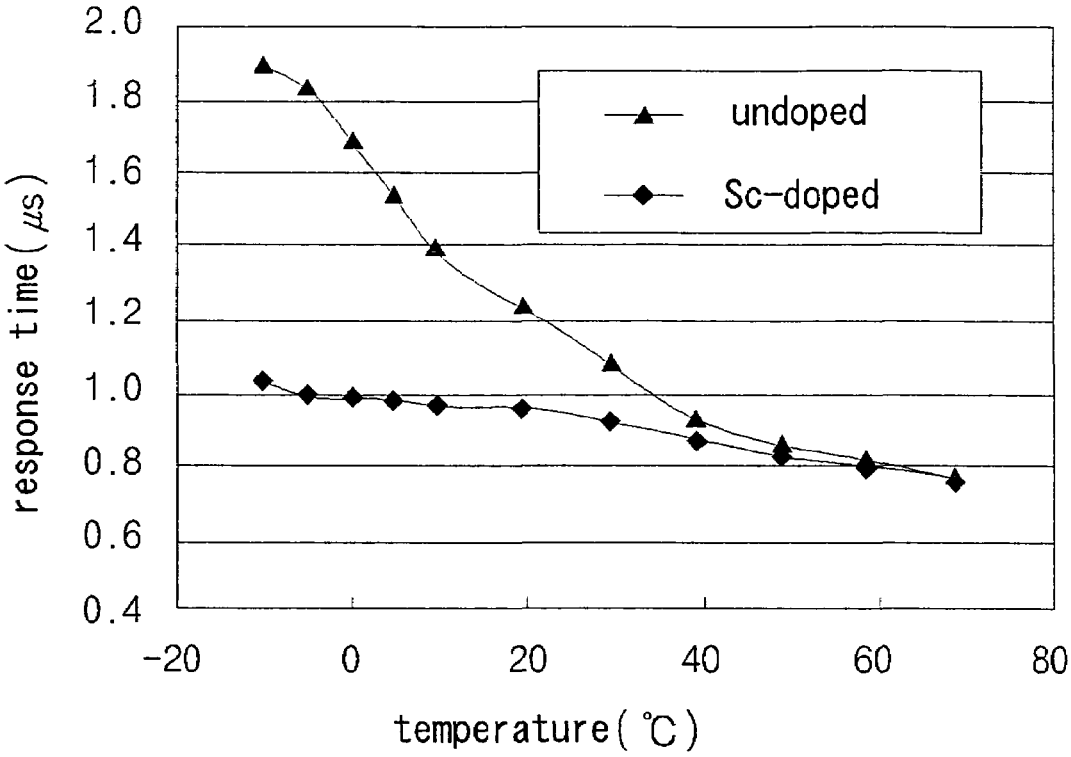
FIG. 6 is a graph showing the response time change according to temperatures for the respective cases in which a protective layer is made of magnesium oxide (MgO) only, and a protective layer is made of magnesium oxide (MgO) and doped with scandium (Sc)

FIG. 6 is a graph showing the response time change according to temperatures, in the cases in which a protective layer is made of only magnesium oxide (MgO) and the other protective layer is formed of magnesium oxide (MgO) and doped with scandium (Sc).

Referring to FIG. 6, the response time of the plasma display panel in the case in which the protective layer 405 is doped with scandium (Sc) 50 is shorter than that in the case in which the protective layer is made only magnesium oxide (MgO). Particularly, at low temperature of −10° C. or below −10° C. the response speed in the case of using the protective layer doped with scandium (Sc) is about twice the response speed in the case of using the protective layer which is not doped with scandium (Sc). This is resulted from that secondary electron emission characteristic is improved as the protective layer is doped with scandium (Sc) in comparison with the case in which the protective layer is made of only magnesium oxide and not doped with doping materials. As a result, an address discharge becomes stable in short time due to the improvement of the secondary electron emission characteristic, so that the response becomes fast even at low temperature.

Further, it is also found that the response time change according to temperatures is not so great, in the case in which the magnesium oxide (MgO) is doped with scandium (Sc). For example, in the case in which the protective layer is formed of only magnesium oxide (Mgo), if a temperature of the plasma display panel abruptly changes, the response time also greatly changes according to the temperature change. On the other hand, in the case in which the protective layer is made of magnesium oxide (MgO) and doped with scandium (Sc), even if the temperature of the plasma display panel abruptly changes, the response time changes in a relatively narrow range. That is, the protective layer made of magnesium oxide (MgO) and doped with scandium (Sc) make the response time change in a narrow range. The response time of the protective layer is determined depending on the quantity of scandium (Sc) in the protective layer, and the relationship between the quantity of scandium (Sc) and the response time is shown in FIG. 7.

Figure 7:
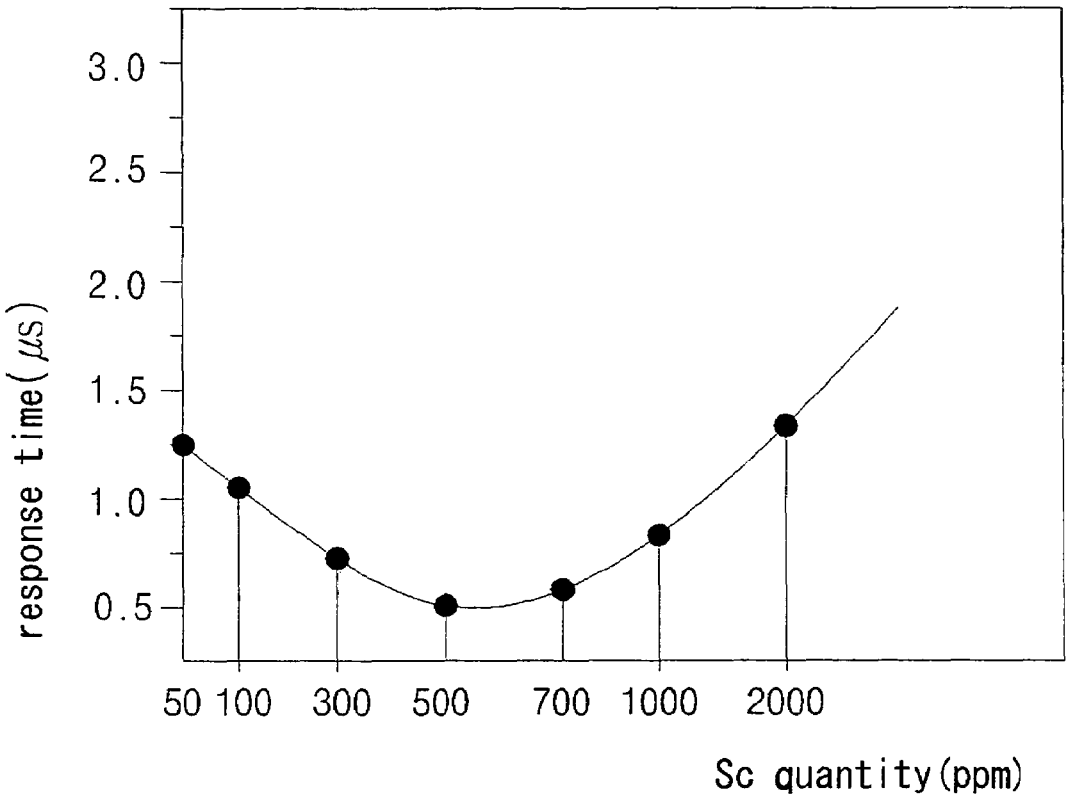
FIG. 7 is a graph showing the response time change according to quantity of scandium (Sc) at a constant temperature, in which quantity of other doping materials in magnesium oxide (MgO) are constant.

FIG. 7 illustrates a graph showing the response time change according to quantity of scandium (Sc) at a constant temperature, in which the protective layer is made of magnesium oxide (MgO) and doped with scandium (Sc) and other doping materials, and quantity of other doping materials is constant.

Referring to FIG. 7, the quantity of the scandium (Sc) doped in the magnesium oxide (Mg) is preferably in the range of from 50 to 2000 ppm, more preferably in the range of from 100 to 1000 ppm, and the most preferably in the range of from 300 to 700 ppm.

In the case in which the quantity of the scandium (Sc) in magnesium oxide (MgO) is lower than 50 ppm, reduction effect of the variation range of the response time is so little. On the other hand, in the case in which the quantity of the scandium (Sc) in magnesium oxide (MgO) is higher than 2000 ppm, unique crystal structure of magnesium oxide (MgO) is deformed, resulting in deterioration of the original characteristic of magnesium oxide (MgO).

According to another embodiment of the present invention, a protective layer made of magnesium oxide (MgO) and doped with calcium (Ca) is provided. The characteristic of the protective layer made of magnesium oxide (MgO) and doped with calcium (Ca) will be described with reference to FIG. 8.

Figure 8:
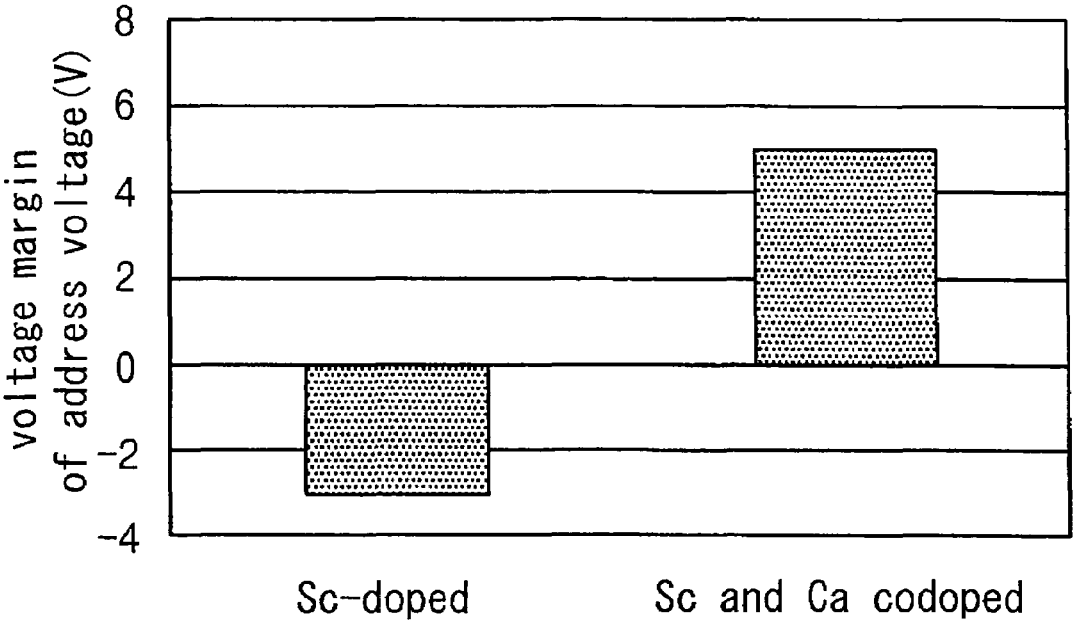
FIG. 8 is a graph showing the comparison of voltage margin of address voltages (Va) at 60° C. for the cases in which a protective layer is made of magnesium oxide (MgO) and doped with scandium (Sc) and a protective layer is made of magnesium oxide (MgO) and doped with scandium (Sc) and calcium (Ca)

FIG. 8 illustrates the comparison of the voltage margin of the address voltage (Va) at 60° C. for the cases in which a protective layer is made of magnesium oxide (MgO) and doped with scandium (Sc), and a protective layer is made of magnesium oxide (MgO) and doped with scandium (Sc) and calcium (Ca).

As shown in FIG. 8, the purpose of calcium (Ca) doping is not to improve the response time at low temperature but to improve the voltage margin of the address voltage (Va) at high temperature. That is, the protective layer has a positive value of the address voltage margin in the case in which magnesium oxide (MgO) is doped with not only scandium (Sc) but also calcium (Ca) while the protective layer has a negative value of the address voltage margin in the case in which magnesium oxide (MgO) is doped with only scandium (Sc). The magnesium oxide (Mg) doped with calcium (Ca) has the relatively improved address voltage margin, thereby improving the address jitter.

Figure 9:
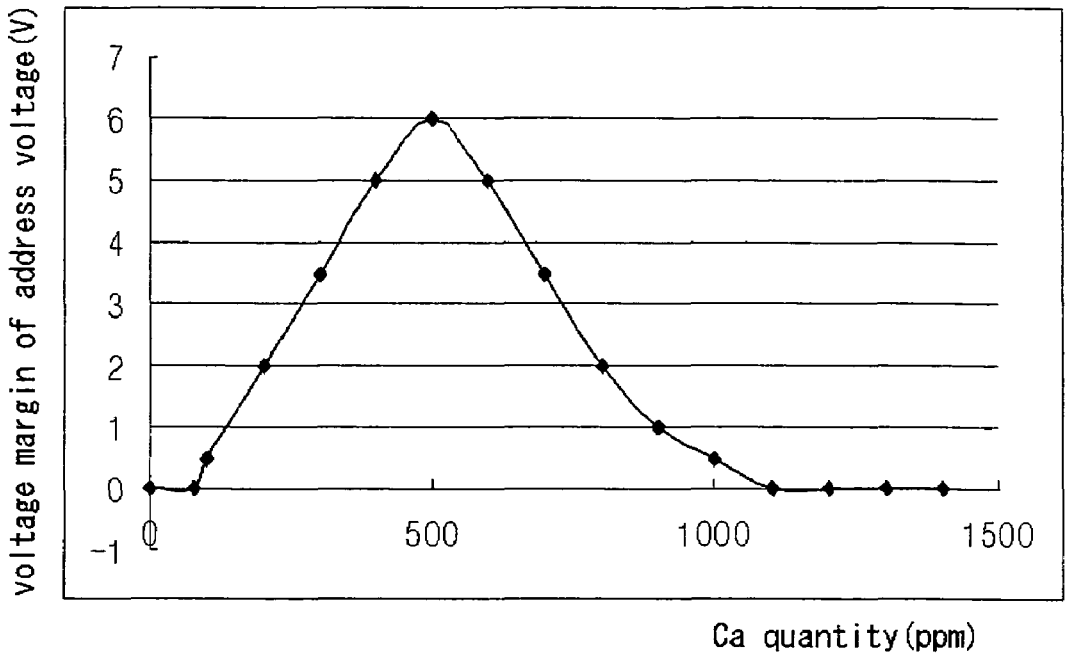
FIG. 9 is a graph showing the response time change according to quantity of calcium (Ca) at a constant temperature, in which the quantity of calcium (Ca) in magnesium oxide (MgO) varies while quantity of other doping materials in the magnesium oxide (MgO) are constant.

FIG. 9 illustrates the voltage margin change according to quantity of calcium (Ca) in magnesium oxide (MgO) in the case in which the magnesium (MgO) is doped with scandium (Sc) and calcium (Ca), quantity of the other doping materials except for calcium (Ca) is constant and a temperature of the magnesium oxide (MgO) is constant.

As shown in FIG. 9, the quantity of calcium (Ca) in magnesium oxide (Mg) preferably ranges from 100 to 1000 ppm, and more preferably 500 ppm.

If the doping quantity of calcium (Ca) is lower than 100 ppm, or higher than 1000 ppm, the voltage margin of the address voltage does not have a positive value.

Figure 10:
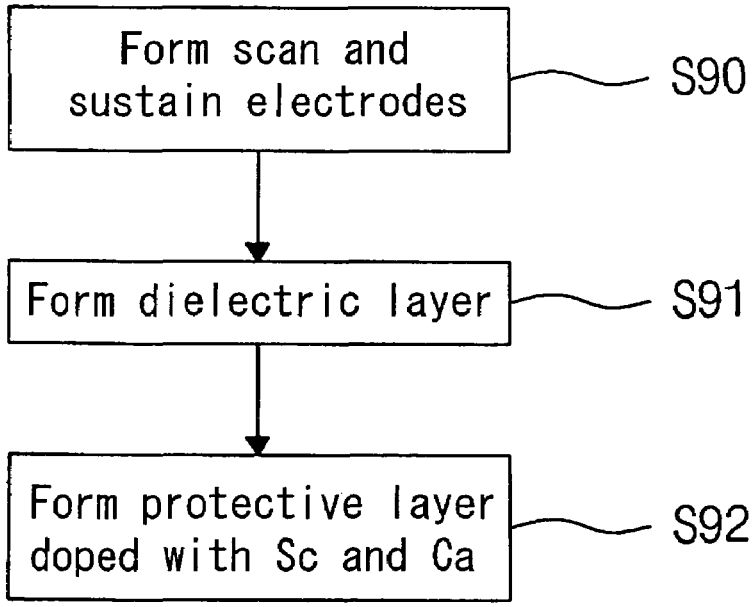
FIG. 10 is a flow chart showing a method of manufacturing a plasma display panel according to an embodiment of the present invention.

FIG. 10 illustrates a flow chart showing a method of manufacturing a plasma display panel, according to an embodiment of the present invention.

As shown in FIG. 10, scan and sustain electrodes are formed on a front glass (not shown) (S90).

Next, on the front glass having the scan and sustain electrodes formed in the step S90, a dielectric layer is formed to cover the scan and sustain electrodes (S91).

Next, a protective layer is formed on the dielectric layer formed in the step S91 (S92). The protective layer is mainly formed of magnesium oxide (MgO) and doped with scandium (Sc) and calcium (Ca).

The protective layer made of magnesium oxide (MgO) and doped with scandium (Sc) and calcium (Ca) is preferably formed by a vacuum vapor deposition method.

Further, the protective layer according to the present invention can be formed by a chemical vapor deposition method, an E-beam method, an ion-plating method, or a sputtering method.

Figure 11:
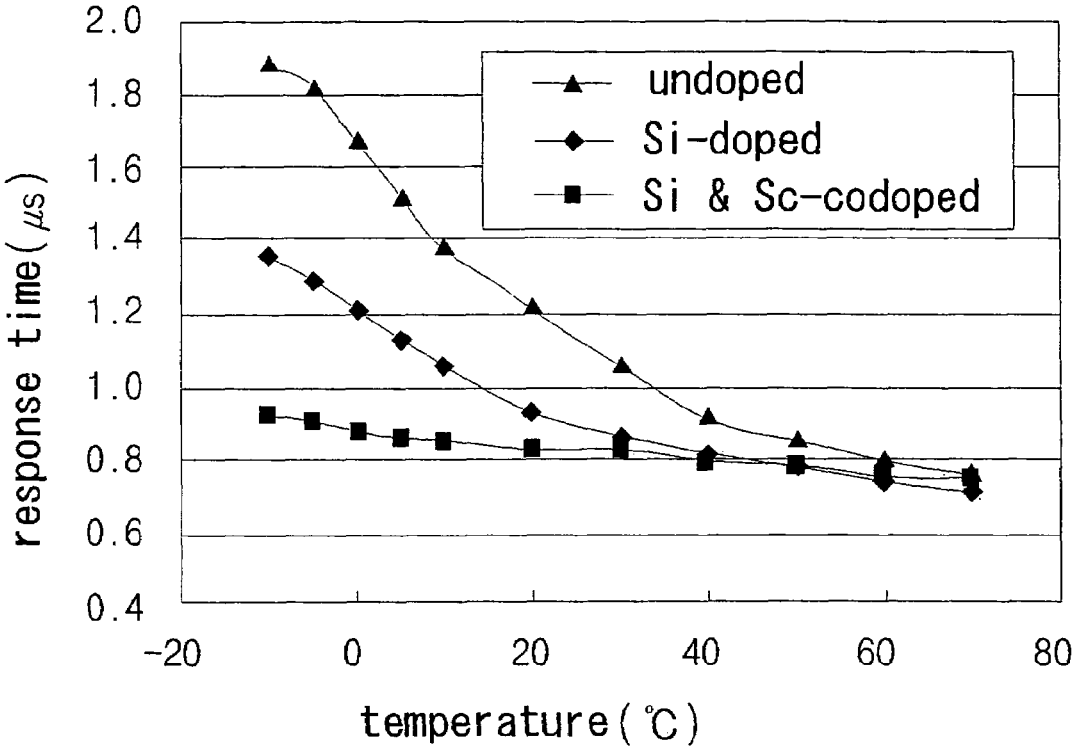
FIG. 11 is a graph showing the response time change according to temperatures for the respective cases in which a protective layer is made of only magnesium oxide (MgO), a protective layer is made of magnesium oxide (MgO) and doped with silicon (Si), and a protective layer is made of magnesium oxide (MgO) and doped with silicon (Si) and scandium (Sc)

FIG. 11 illustrates a graph showing the response time change according to temperatures for the cases in which a protective layer is formed of only magnesium oxide (MgO), a protective layer is formed of magnesium oxide (MgO) and doped with silicon (Si), and a protective layer is formed of magnesium oxide (MgO) and doped with silicon (Si) and scandium (Sc).

As shown in FIG. 11, the response time of the case in which the protective layer is formed of magnesium oxide (MgO) and doped with silicon (Si) is shorter than that of the case in which the protective layer is formed of only magnesium oxide (MgO) due to the enhanced secondary electron emission characteristic. That is, as the secondary electron emission is enhanced, an address discharge is stably caused in short time. As a result, the response time is short even at low temperature.

Further, in the case in which the protective layer made of magnesium oxide (MgO) is doped with scandium (Sc) as well as silicon (Si), the range of the response time change is narrow as in the case in which the protective layer is formed of magnesium oxide (MgO) and doped with only scandium (Sc), and the response time is shorter in comparison with the case in which the protective layer is formed of magnesium oxide (MgO) and doped with only silicon (Si). As shown in FIG. 11, the response time of the case in which the protective layer is doped with silicon (Si) together with scandium (Sc) is shorter than that of the case in which the protective layer is doped with only scandium (Sc).

Figure 12:
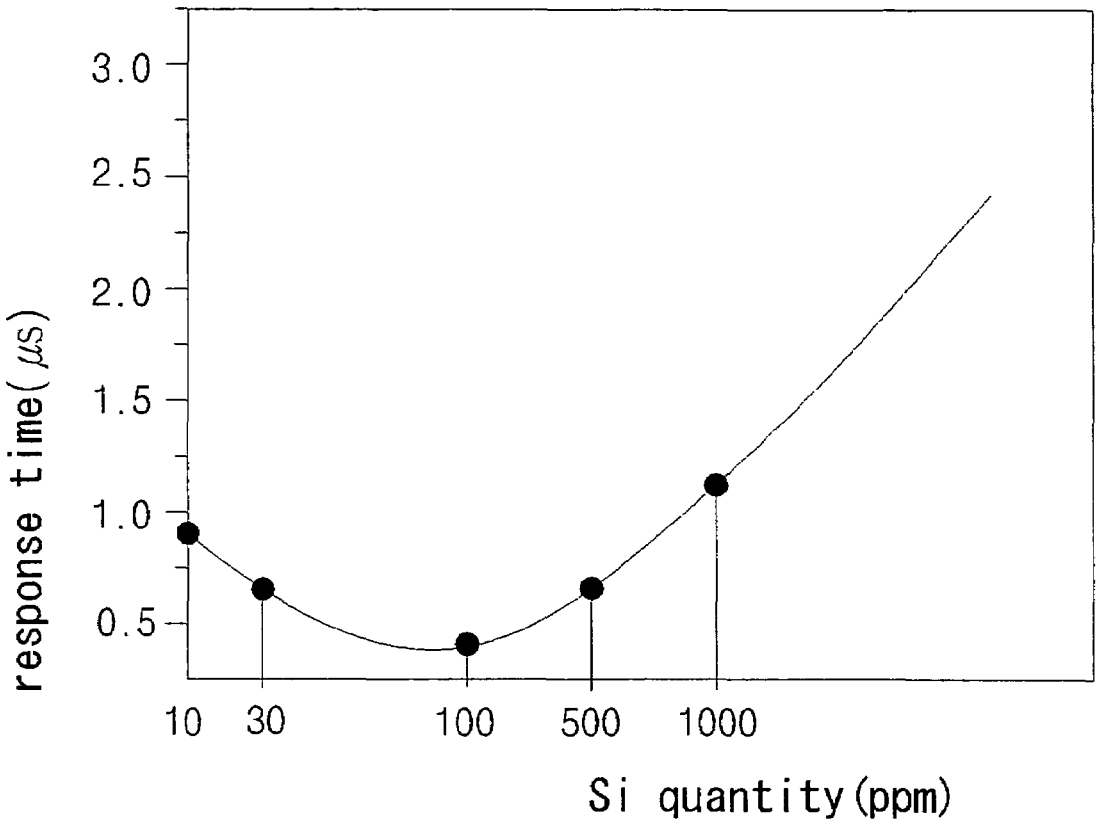
FIG. 12 is a graph showing the response time change according to quantity of silicon (Si) in magnesium oxide (Mg) at a constant temperature, wherein quantity of other doping materials except for the silicon (Si) are constant.

FIG. 12 illustrates a graph showing the response time change according to quantity of silicon (Si) in MgO, in which a temperature of the protective layer and a quantity of other doping materials except for silicon (Si) are constant.

As shown in FIG. 12, the quantity of silicon (Si) in magnesium oxide (MgO) preferably ranges from 10 ppm to 1000 ppm, and more preferably ranges from 30 ppm to 500 ppm. In the case in which the quantity of silicon (Si) in magnesium oxide (MgO) is lower than 10 ppm, the intended reduction effect of the response time is just a little. On the other hand, in the case in which the quantity of silicon (Si) in magnesium oxide (MgO) is higher than 1000 ppm, crystal structure of magnesium oxide (MgO) is deformed, resulting in deterioration of unique characteristic of magnesium oxide (MgO).

Figure 13:
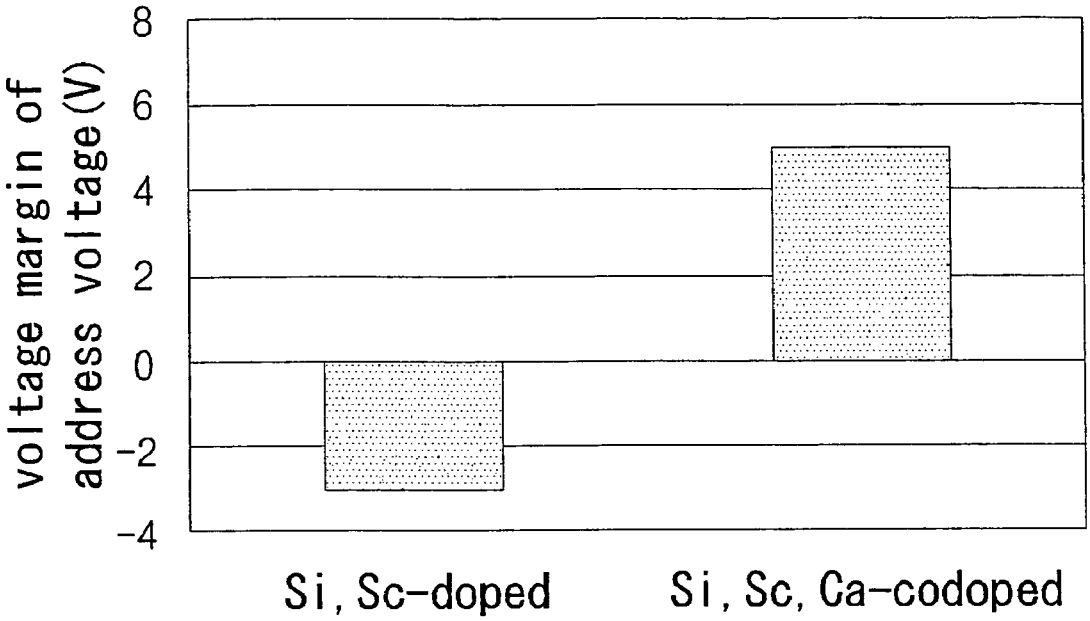
FIG. 13 is a graph showing the comparison of voltage margin of address voltages at 60° C. for the cases in which a protective layer is made of magnesium oxide and doped with silicon (Si) and scandium (Sc) and a protective layer is made of magnesium oxide and doped with silicon (Si), scandium (Sc) and calcium (Ca)

FIG. 13 illustrates a graph showing the comparison of the voltage margin of address voltages Va at 60° C. for the cases in which magnesium oxide (MgO) is doped with silicon (Si) and scandium (Sc), and in which magnesium oxide is doped with calcium (Ca) together with silicon (Si) and scandium (Sc).

As shown in FIG. 13, the reason of the calcium (Ca) doping is not to improve the response time characteristic at low temperature, but to improve the voltage margin characteristic of the address voltage (Va) at high temperature. That is, in the case in which magnesium oxide (MgO) is doped with silicon (Si) and scandium (Sc), the voltage margin of the address voltage (Va) has a negative value. On the other hand, in the case in which magnesium oxide (MgO) is doped with calcium (Ca) as well as silicon (Si) and scandium (Sc), the voltage margin has a positive value. That is, the protective layer mainly formed of magnesium oxide (MgO) and doped with calcium (Ca) has the more improved voltage margin of address voltage. Accordingly, jitter is improved.

Figure 14:
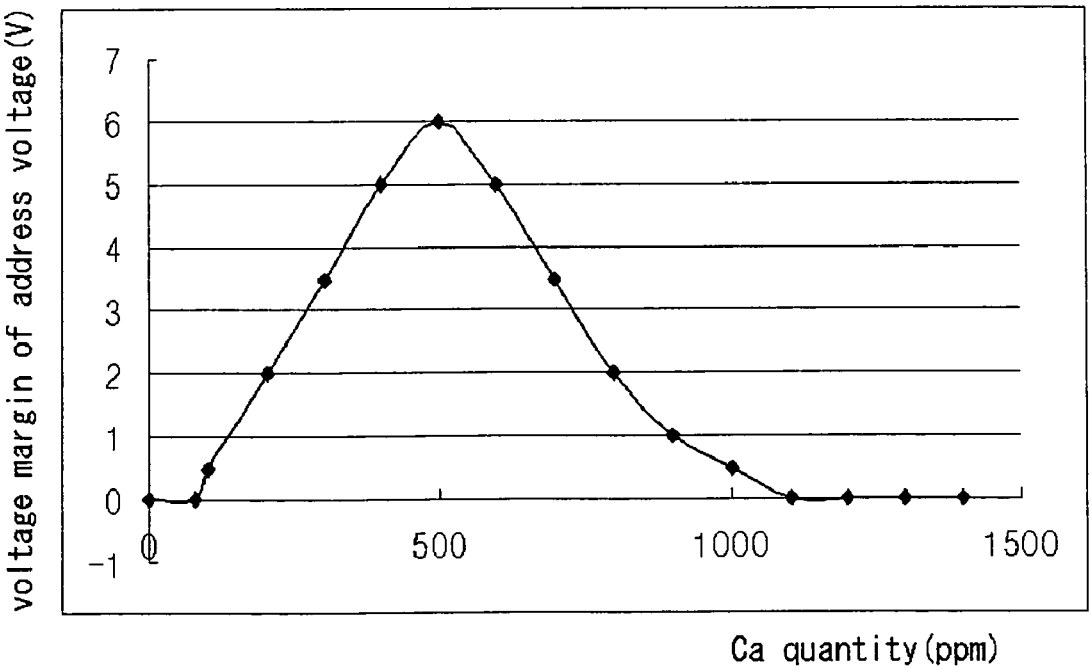
FIG. 14 is a graph showing the voltage margin change according to quantity of calcium (Ca) at a constant temperature for the case in which scandium (Sc), silicon (Si) and calcium (Ca) are doped into magnesium oxide (MgO), and the quantity of the calcium (Ca) varies while the quantity of the scandium (Sc) and silicon (Si) are constant.

FIG. 14 illustrates a graph showing the voltage margin change according to quantity of calcium (Ca) in the case in which magnesium oxide (MgO) is doped with scandium (Sc), silicon (Si) and calcium (Ca), in which quantity of the scandium (Sc) and silicon (Si) are constant.

As shown in FIG. 14, the quantity of calcium (Ca) in magnesium oxide (MgO) preferably ranges from 100 to 1000 ppm, and more preferably 500 ppm.

If the quantity of calcium (Ca) in magnesium oxide (MgO) is lower than 100 ppm or higher than 1000 ppm, the voltage margin of address voltage does not have a positive value.

The protective layer comprising a magnesium oxide (MgO) layer doped with silicon (Si), scandium (Sc) and calcium (Ca) is formed by a vacuum vapor deposition method.

The protective layer further can be formed by a chemical vapor deposition (CVD) method, an E-beam method, an ion-plating method, or a sputtering method.

The plasma display panel with the above described protective layer, according to the present invention, is excellent in temperature-dependent panel characteristic. Particularly, since the secondary electron emission efficiency of the protective layer is enhanced, an address discharge is stably caused in short time. Accordingly, the response time at low temperature is short and the range of the response time change is narrow.

Further the voltage margin of address voltage (Va) is excellent.

The invention being thus described, it will be obvious that the same may in many ways. Such variations are not to be regarded as a departure from the scope of the invention, and all such modifications as would be obvious to one the art are intended to be included within the scope of the following claims.

What is claimed is:

1. A plasma display panel comprising:

a front panel comprising a protective layer; and a rear panel disposed apart from the front panel by a predetermined distance and combined with the front panel, wherein the protective layer comprising magnesium oxide (MgO) is doped with scandium (Sc) and calcium (Ca).

2. The plasma display panel of claim 1, wherein the quantity of the scandium (Sc) for doping ranges from 50 ppm to 2,000 ppm.

3. The plasma display panel of claim 2, wherein the quantity of the scandium (Sc) for doping ranges from 100 ppm to 1,000 ppm.

4. The plasma display panel of claim 3, wherein the quantity of the scandium (Sc) for doping ranges from 300 ppm to 700 ppm.

5. The plasma display panel of claim 1, wherein the quantity of the calcium (Ca) for doping ranges from 100 ppm to 1,000 ppm.

6. A plasma display panel comprising:

a front panel comprising a protective layer; and a rear panel disposed apart from the front panel by a predetermined distance and combined with the front panel, wherein the protective layer comprising magnesium oxide (MgO) is doped with scandium (Sc), silicone (Si), and calcium (Ca).

7. The plasma display panel of claim 6, wherein the quantity of the scandium (Sc) for doping ranges from 50 ppm to 2,000 ppm.

8. The plasma display panel of claim 7, wherein the quantity of the scandium (Sc) for doping ranges from 100 ppm to 1,000 ppm.

9. The plasma display panel of claim 8, wherein the quantity of the scandium (Sc) for doping ranges from 300 ppm to 700 ppm.

10. The plasma display panel of claim 6, wherein the quantity of the silicon (Si) for doping ranges from 10 ppm to 1,000 ppm.

11. The plasma display panel of claim 10, wherein the quantity of the silicon (Si) for doping ranges from 30 ppm to 500 ppm.

12. The plasma display panel of claim 6, wherein the quantity of the calcium (Ca) for doping ranges from 100 ppm to 1,000 ppm.

13. A plasma display panel comprising:

a front panel comprising a protective layer; and a rear panel disposed apart from the front panel by a predetermined distance and combined with the front panel; wherein the protective layer comprising magnesium oxide (MgO) is doped with scandium (Sc) and silicon (Si).

14. The plasma display panel of claim 13, wherein the quantity of the scandium (Sc) for doping ranges from 50 ppm to 2,000 ppm.

15. The plasma display panel of claim 14, wherein the quantity of the scandium (Sc) for doping ranges from 100 ppm to 1,000 ppm.

16. The plasma display panel of claim 15, wherein the quantity of the scandium (Sc) for doping ranges from 300 ppm to 700 ppm.

17. The plasma display panel of claim 13, wherein the quantity of the silicon (Si) for doping ranges from 10 ppm to 1,000 ppm.

18. The plasma display panel of claim 17, wherein the quantity of the silicon (Si) for doping ranges from 30 ppm to 500 ppm.

19. The plasma display panel of claim 1, wherein a response time of the panel changes by an amount that is less than or substantially equal to 0.3 μs within a temperature range of −10° C. and 70° C. based on quantities of scandium (Sc) and calcium (Ca) doped into the protective layer.

20. The plasma display panel of claim 19, wherein a response time of the panel changes by an amount that is less than or substantially equal to 0.2 μs within a temperature range of −10° C. and 70° C. based on quantities of scandium (Sc) and calcium (Ca) doped into the protective layer.

21. The plasma display panel of 19, wherein an address discharge of at least one discharge cell in the panel achieves a stable state in an amount of time proportional to a secondary emission characteristic that corresponds to said response time.

22. The plasma display panel of claim 19, wherein the response time reduces from a first time value to a second time value when the quantity of Sc lies in a range of between a first quantity and a second quantity.

23. The plasma display panel of claim 22, wherein the first quantity is 50 ppm and the second quantity is 500 ppm.

24. The plasma display panel of claim 22, wherein the response time increases from a third time value to a fourth time value when the quantity of Sc lies in a range of between a third quantity and a fourth quantity.

25. The plasma display panel of claim 24, wherein the fourth quantity is 2000 ppm.

26. The plasma display panel of claim 1, wherein a voltage margin of an address voltage in at least one discharge cell of the panel is a positive value based on quantities of Sc and Ca doped into the protective layer.

27. The plasma display panel of claim 26, wherein the voltage margin is between a first positive value and a second positive value when the quantity of Ca is between a first quantity and a second quantity.

28. The plasma display panel of claim 27, wherein the second quantity is 500 ppm.

29. The plasma display panel of claim 27, wherein the voltage margin follows a substantially linear curve between the first and second time values.

30. The plasma display panel of claim 27, wherein the voltage margin is between a third positive value and a second positive value when the quantity of Ca is between a third quantity and a fourth quantity.

31. The plasma display panel of claim 30, wherein the fourth quantity is 1000 ppm.

* * * * *